United States Patent [19]

Gruns

[11] Patent Number: 4,627,125

[45] Date of Patent: Dec. 9, 1986

[54] PAINT BRUSH

[76] Inventor: James H. Gruns, 5080 Woodson Dr., Mission, Kans. 66202

[21] Appl. No.: 663,953

[22] Filed: Oct. 22, 1984

Related U.S. Application Data

[63] Continuation-in-part of Ser. No. 431,788, Sep. 30, 1982, Pat. No. 4,490,875.

[51] Int. Cl.[4] ..... A46B 3/02; A46B 17/06

[52] U.S. Cl. ..... 15/105; 15/159 A; 15/192; 15/257 R; 15/143 R; 211/66; 248/110

[58] Field of Search ..... 15/143 R, 159 A, 159 R, 15/160, 192, 193, DIG. 5, DIG. 6, 257; 248/110; 211/65, 66

[56] References Cited

U.S. PATENT DOCUMENTS

| | | | |
|---|---|---|---|
| 1,086,858 | 2/1914 | Richards | 248/110 |
| 2,406,732 | 8/1946 | Hardman | 15/192 |
| 2,913,751 | 11/1959 | Hardman et al. | 15/192 |
| 2,952,364 | 9/1960 | Jacobson | 211/65 |
| 4,490,875 | 1/1985 | Grunz | 15/192 X |

FOREIGN PATENT DOCUMENTS

| | | | |
|---|---|---|---|
| 884771 | 11/1971 | Canada | 15/160 |
| 309419 | 4/1929 | United Kingdom | 15/159 |
| 967679 | 8/1964 | United Kingdom | 211/65 |

*Primary Examiner*—Peter Feldman

[57] ABSTRACT

This invention is directed to a surface coatings applicator and applicator cleaning container assembly where in the applicator has a special contoured handle with several openings that aid in the proper cleaning/soaking of the applicator's bristles/filaments when used in conjunction with the special cleaning/soaking container. Furthermore said bristles/filaments may be of differing lengths, color/shade and/or color patterns so as to aid in the proper dipping of said bristles into a container of surface coatings.

3 Claims, 7 Drawing Figures

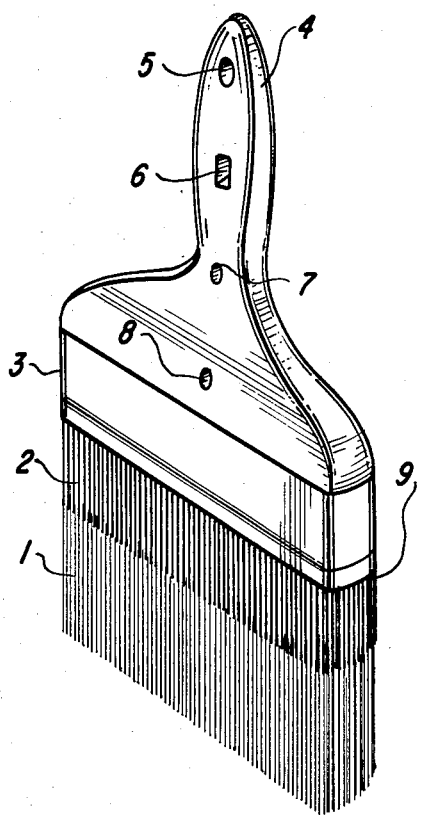
FIG. 1
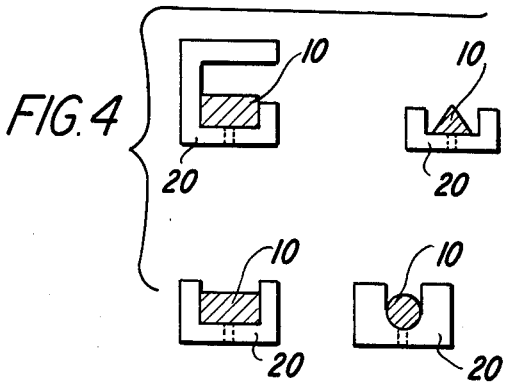
FIG. 4
FIG. 3
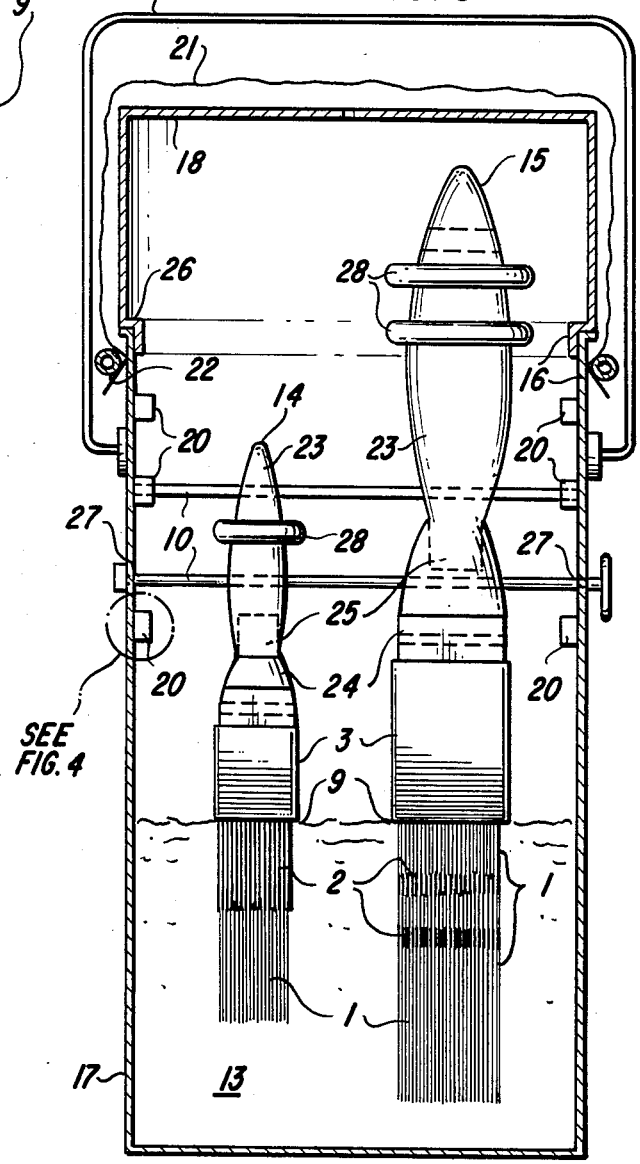

PAINT BRUSH

This specification, claims and abstract are to be considered a continuation-in-part of application Ser. No. 06/431,788 filed Sept. 30, 1982, now U.S. Pat. No. 4,490,875.

This invention relates to an improved surface coatings applicator with a cleaning container. The applicator, as one example, can be a paint brush having a bristle or filament sub-assembly comprised of bristles and/or filaments of specific lengths, color, or shade and/or color patterns. The brush handle may be of one, or more contoured structural sections and can have several strategically located openings such that this applicator will be easier to clean when used in conjuction with the special cleaning container (or a household food container) and therefore have a longer useful life. Furthermore, the special cleaning container assembly is made of a clear, semi-clear, solvent resistant, rigid and/or semi-rigid material comprising (a) a base structure which holds the cleaning solvent, brush-rod support brackets, and (b) a cover that reduces the spillage or evaporation of the solvent.

Most painters, professional and non-professional, severely reduce the life of paint brushes by improper use or cleaning. Several text books on correct painting techniques specifically state that the paint brush should be dipped into the paint supply, no more than one-half the length of the bristles. Dipping the brush deeper results in the paint saturating the bristle area nearest the brush ferrule; resulting in the potential for the paint to harden in an area of the brush that is difficult to clean. It is accordingly, one principal object of this invention to obviate such a problem by the provision of bristle lengths, color and/or shade and, color patterns that act as visual aids to reduce the tendency of painters to improperly dip the paint brush into a paint supply.

Realizing the possibility that any painter could accidentally dip a paint brush too deeply into the paint, another object of this invention is to provide a paint brush that can be cleaned effectively by proper soaking in an appropriate paint coatings solvent. The strategically located handle openings enable the painter to use a wire or rod to hang this applicator in a number of common household containers filled with solvent to the proper level immediately. Furthermore, these holes are located as to enable several different lengths of brush bristles to be soaked in the same container of solvent on the same wire or rod.

Other important advantages or objects of this invention will become apparent from the disclosure in the specification and accompanying drawings, in which:

FIG. 1 is a perspective of the paint brush.

FIG. 3 is a sectional view of the container assembly.

Figure 2:
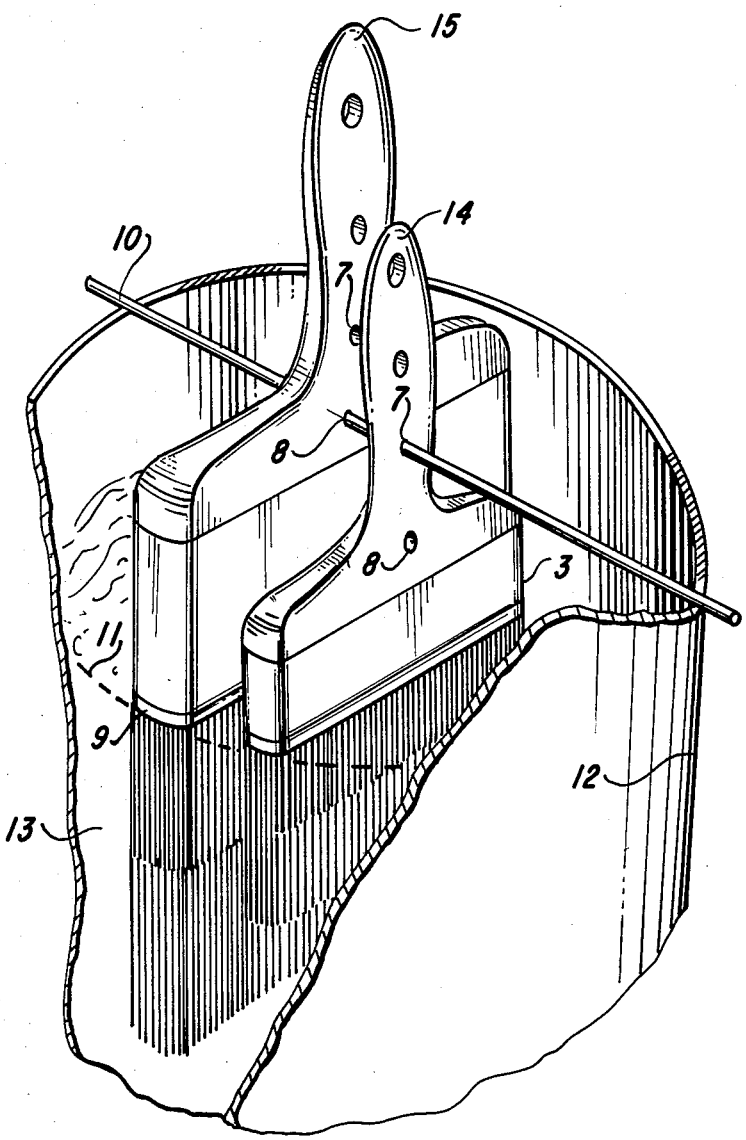
FIG. 2 is a sectional view showing two different sizes of this paint brush being soaked in a paint cleaner solvent.

FIGS. 4*a*, 4*b*, 4*c*, and 4*d* are end views of some of the several compatible support rod bracket configurations that can secured rods having round, oval, triangular and/or polygonal cross-sections.

Referring to FIG. 1, the main bristles 1 may be approximately twice as long as the guide bristles 2. One way this may be achieved is by cutting the outer layer of the main bristles 1 to the shorter length bristles 2. Furthermore, the guide bristles 2 are of a different color than the main bristles 1. For example, black main bristles 1 and white guide bristels 2 or white main bristles 1 and red guide bristles 2 would create a visual aid to help prevent the painter from dipping the brush too deeply into the paint supply. Equally effective would be main bristles or filaments 1 having (via permanent dying, staining, coating, heat discoloration, pigmentation, etc.) a distinct change in color and/or shade of color at the approximate midpoint of the bristles or filaments 1 where said color or shade will extend up to the ferrule edge 9 as a solid color or shade or as an intermittent pattern such as distinct lines of color or shade perpendicular to the longitudinal axis of the bristles/filaments 1.

Based on some of the books cited, the proper way to clean paint hardened bristles 1 and 2 is to immerse the bristles 1 and/or 2 in paint solvent 13. Current brush handle 4 designs have a single hole 5 located at the extreme end of the handle 4. Therefore, cleaning the bristles 1 or 2 would require using a very tall container 12, because the main bristles 1 while soaking should not be permitted to touch the bottom of the container 12 or the bristles 1 could become bent and consequently reduce or destroy their usefulness. For the purpose of illustration, holes 6 and 7 are positioned a distance from the ferrule edge 9 that would enable bristle 1 or 2 soaking in a typical three pound and one pound coffee cans, respectively. Hole 8 is positioned for bristle 1 and 2 soaking in a number 303 can, commonly used as a one pound food can.

In general a larger paint brush 15 has longer bristles 1 or 2 and a longer handle 4. However the proper level of paint solvent is still just below the ferrule edge 9; regardless of the brush size. Therefore, to efficiently soak a large brush 15 and a small brush 14 at the same time in the same container 12, the rod 10 would be placed through hole 8 on the larger brush 14 and hole 7 in the smaller brush 14.

The rod 10 and any opening 6, 7, or 8, may also be an oval or polygon in cross-section to prevent brush rotation, in cases where the brush centroid of mass is above the rod.

FIG. 3 shows one configuration of this applicator cleaning container assembly 16 having a solvent 13 holding base 17, a cover or lid 18 and an assembly carrying handle or strap 19. The base 17 may also have integral mounting brackets 20 (See FIGS. 4*a*, 4*b*, 4*c*, and 4*d*) that internally support the rod 10 which internally supports the applicators 14, 15. The base 17 may also support the rod 10 by way of rod support openings 27 in the side-wall of the base 17. This configuration is easily adapted to common household containers 12 in which the cover 21 (wavy line) could be (for one of several examples) of a flexibles solvent resistant material affixed to the base 17 by a semi-elastic rubber band-like element 22 which is more readily affixed to the container 16 by the special flange 26 integral to the base 17.

FIG. 3 also shows possible configurations for the the multi-sectioned handle 4. In this example the handles 14 and 15 are in two sections 23, 24 that are joined together by compression type fittings 25. The fittings 25 of brush 14 is prefered because "male" portion of this section 24 is easier to clean. Removal of the upper handle sections 23, permits the container assemblies 12, 16 to be much shorter by only soaking the bristles 1 and/or 2 of the lower section 24. Also shown are the special handle contours 28 that give a much better surface for the painter to grip when the handle becomes slippery with the paint.

FIG. 4*b* shows the end view of a triangular support rod. This configuration is important when soaking angle sash type brushes.

I claim:

1. A surface coatings applicator and applicator cleaning container assembly, wherein the applicator is comprised of a tubular ferrule having a cluster of bristles inserted part way into one end substantially to seal one end or said ferrule; a hardened mass of cured, resinous cement disposed atop said cluster of bristles in firm adhesive connection with portions of said cluster of bristles in said ferrule; and an integral handle including a contoured gripping portion extending outwardly from the other end of said tubular ferrule;

said handle being of rigid material and having a series of vertically aligned openings that extend through said handle such that a rod may inserted completely through a selected opening;

said openings having a round, triangular, polygon, or oval cross-section, and are located at specific distances from the lower edge of the ferrule, into which the bristle cluster is inserted, such that said rod, can be used to support one or more applicators of the same or differing length and/or size in a container of solvent, such that the level of solvent only covers the bristles of each applicator up to the lower edge of each ferrule for proper soaking and cleaning of all clusters of bristles;

said openings having a cross-section, such that said rod being provided with a similar cross section as said openings, will prevent rotation of the brush around said rod when the brush centroid of mass of the brush is above said rod;

said cluster of bristles being made of two bristle sub-groups and being distinctly different in bristle length and/or bristle color and/or shade;

said first bristle sub-group being longer and used for applying the surface coatings;

said second bristle sub-group being significantly shorter and/or of a contrasting color and/or shade to the first bristle sub-group, so as the reduce the possibility of a painter dipping the applicator too deeply into the coatings supply container.

2. The invention of claim 1, wherein there is only one bristle sub-group such that only one bristle cluster having a distinct color, pattern and/or shade change at the approximate midpoint of the bristles, where said change extends to said lower ferrule edge.

3. The invention of claim 1, wherein the cleaning container is constructed of semi-clear, rigid, semi-rigid, impervious, and/or solvent-proof material and comprises a base, cover, and an assembly carrying handle or strap;

said solvent containing base has vertical surfaces that have integral rod support brackets and/or rod support openings;

said cover and base have compatible mating configurations so as to help prevent solvent spillage and/or solvent evaporation;

said handle or strap being affixed to said assembly base and/or cover.

* * * * *